235-382
2/23/88 XR 4,727,368

United States Patent [19]
Larson et al.

[11] Patent Number: 4,727,368
[45] Date of Patent: Feb. 23, 1988

[54] ELECTRONIC REAL ESTATE LOCKBOX SYSTEM

[75] Inventors: Wayne F. Larson, Salem; Walter G. Henderson, Corvallis, both of Oreg.

[73] Assignee: Supra Products, Inc., Salem, Oreg.

[21] Appl. No.: 831,601

[22] Filed: Feb. 21, 1986

Related U.S. Application Data

[63] Continuation-in-part of Ser. No. 814,364, Dec. 30, 1985, abandoned, which is a continuation-in-part of Ser. No. 788,072, Oct. 16, 1985, abandoned.

[51] Int. Cl.[4] ..... E05B 49/00
[52] U.S. Cl. ..... 340/825.310; 70/63; 235/382; 379/103
[58] Field of Search ..... 70/63, 210; 179/2 A (U.S. only); 235/382, 382.5; 340/825.32, 306, 825.31, 825.56; 379/103

[56] References Cited

U.S. PATENT DOCUMENTS

| | | | |
|---|---|---|---|
| 3,465,131 | 9/1969 | Eyck | 235/493 X |
| 3,872,435 | 3/1975 | Cestaro | 340/825.32 |
| 4,079,605 | 3/1978 | Bartels | 70/277 |
| 4,148,092 | 4/1979 | Martin | 70/283 |
| 4,201,887 | 5/1980 | Burns | 379/96 |
| 4,353,064 | 10/1982 | Stamm | 235/382 X |
| 4,439,670 | 3/1984 | Basset et al. | 235/382.5 X |
| 4,509,093 | 4/1985 | Stellberger | 340/825.31 |
| 4,525,805 | 6/1985 | Prosan et al. | 364/900 |
| 4,558,175 | 12/1985 | Genest et al. | 235/382 X |
| 4,609,780 | 9/1986 | Clark | 379/103 |
| 4,656,463 | 4/1987 | Anders et al. | 340/572 |

FOREIGN PATENT DOCUMENTS 1582989 1/1981 United Kingdom .

OTHER PUBLICATIONS

Supra Products, Inc. brochure "Agent Key for the EAC-1000 Key Safe System," 1982.
Supra Products, Inc.; brochure, "A New Dimension in Key Box Systems, by Spura, The EAC-1000 Key Safe System," 1982.
Supra Products, Inc. brochure "EAC-1000, Documented Electronic Access Control System From Supra.," Sep. 1983.

*Primary Examiner*—Jin F. Ng
*Assistant Examiner*—Mark E. Ham
*Attorney, Agent, or Firm*—Klarquist, Sparkman, Campbell, Leigh & Whinston

[57] ABSTRACT

Real estate lockbox and key designs are disclosed which provide a variety of operational features. Also disclosed is a comprehensive system that allows real estate boards and agencies to efficiently manage their lockbox operations. Features provided by the system include the ability to record all accesses to all lockboxes; transfer all or part of such records from the lockboxes to the real estate agency or board; organize and review such records at the agency or board offices; disable operation of various lockboxes during certain hours of the day; facilitate operation of lockboxes that are mounted in awkward or poorly lit locations; limit lockbox accesses to preselected agents, agencies or boards; and record diagnostic information with each operation of a lockbox or key.

2 Claims, 8 Drawing Figures

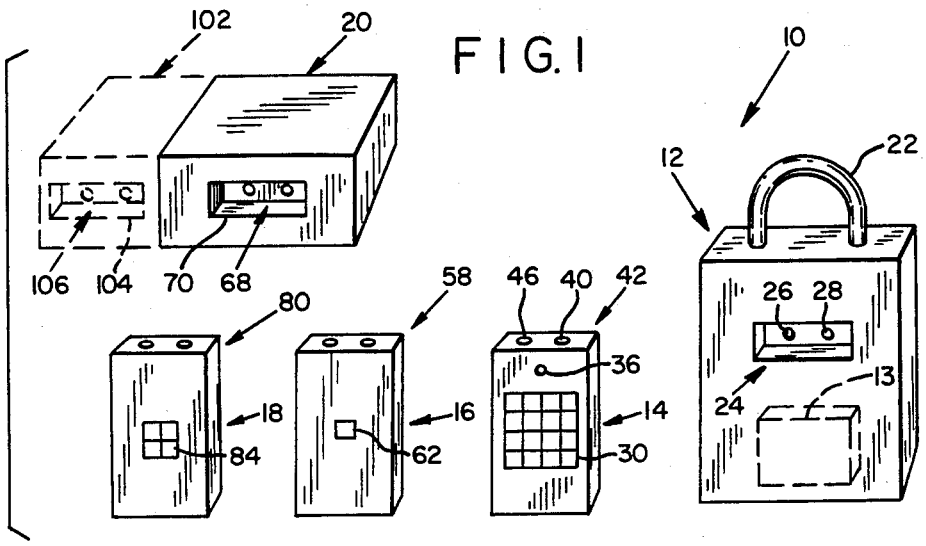
FIG. 1
FIG. 2
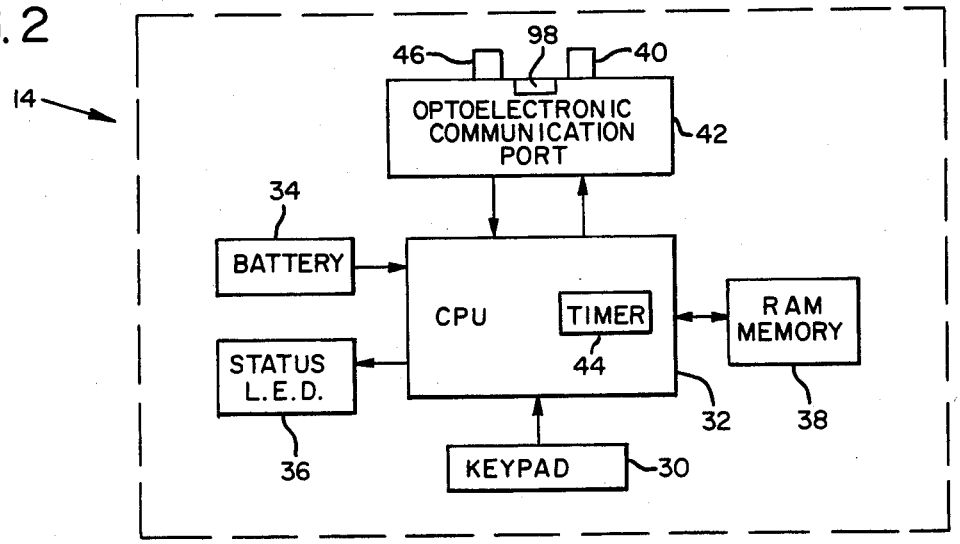
FIG. 3
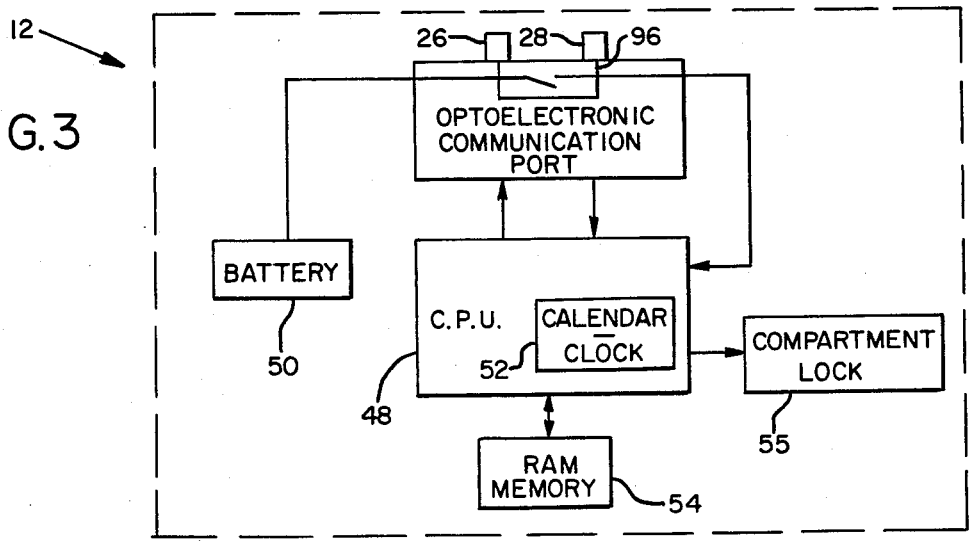

ELECTRONIC REAL ESTATE LOCKBOX SYSTEM

BACKGROUND OF THE INVENTION

This application is a continuation-in-part of application Ser. No. 814,364, filed Dec. 30, 1985, now abandoned, which in turn was a continuation-in-part of copending application Ser. No. 788,072, filed Oct. 16, 1985, also abandoned. These applications are incorporated herein by reference.

The present invention relates to real estate lockboxes. Lockboxes are used in the real estate industry to contain the keys of houses listed for sale. Prior art lockboxes have primarily been mechanical devices which allow access to a secure compartment by use of a conventional key. Such lockboxes and keys, however, have had certain disadvantages.

One disadvantage has been the inability of the lockbox to store information relating to the time and date the lockbox is accessed, together with the identity of the accessing real estate agent. Another disadvantage has been the inability to coordinate large numbers of lockboxes and keys into an integrated system that allows a supervising real estate board to monitor listing activity and to exercise management control over its lockboxes and keys.

Accordingly, a need remains for an improved real estate lockbox, key and lockbox system.

SUMMARY OF THE INVENTION

One feature of the present invention is the provision of a lockbox that records information relating to the time and date the lockbox is accessed, together with the identity of the accessing real estate agent.

Another feature of the invention is the provision of a lockbox system that allows the supervising real estate board to monitor listing activity and to exercise management control over its lockboxes and keys.

Another feature of the invention is the provision of a lockbox that cannot be opened during certain predetermined periods during which a resident homeowner may not welcome visitors.

Yet another feature of the invention is an arrangement whereby certain lockbox keys become inoperative after a certain period of time.

Still another feature of the invention is an arrangement whereby the lockbox can be made inoperative to all real estate agents.

Another feature of the invention is an arrangement whereby the lockbox can be automatically disabled after the shackle holding it in place is released.

Still another feature of the invention is an arrangement whereby software used with the system is protected against misappropriation.

Still another feature of the invention is an arrangement whereby access data stored in the lockbox can be retrieved by a portable unit.

Another feature of the invention is an arrangement whereby a lockbox can be reprogrammed over telephone lines.

Yet another feature of the invention is an arrangement whereby the access log maintained in the lockbox can be marked to enable retrieval of selected portions of the log.

Another feature of the invention is an arrangement whereby codes needed to access the lockbox can be entered on a key before the key is engaged with the lock.

Still another feature of the invention is an arrangement whereby information relating to recent attempts to operate keys and lockboxes are stored in memories within such units to facilitate resolution of anomalous key and lockbox behavior.

Still another feature of the invention is an arrangement whereby certain real estate agents can be prevented from accessing certain lockboxes.

Yet another feature of the invention is the provision of circuitry whereby the lockbox consumes negligible power until a key is coupled thereto.

Still another feature of the invention is an arrangement whereby a listing agent can maintain control over which other agents show a listed house.

Yet another feature of the invention is an arrangement whereby agents from several different real estate boards can obtain access to a real estate lockbox.

Still another feature of the invention is a provision whereby access information retrieved by the portable unit can be coupled to a central data storage unit over telephone lines.

Still another feature of the invention is the provision of a lockbox database containing data on all lockboxes and keys owned by a real estate board.

The foregoing and additional features and advantages of the present invention will be more readily apparent from the following detailed description of a preferred embodiment thereof, which precedes with reference to the accompanying drawings.

BRIEF DESCRIPTION OF THE DRAWINGS

FIG. 1 is a diagram of a Level One system, with a component from a Level Two system shown in dashed lines.

FIG. 2 is a schematic block diagram of an agent key used in the system of FIG. 1.

FIG. 3 is a schematic block diagram of a lockbox used in the system of FIG. 1.

DETAILED DESCRIPTION OF A PREFERRED EMBODIMENT LEVEL ONE SYSTEM

Figure 4:
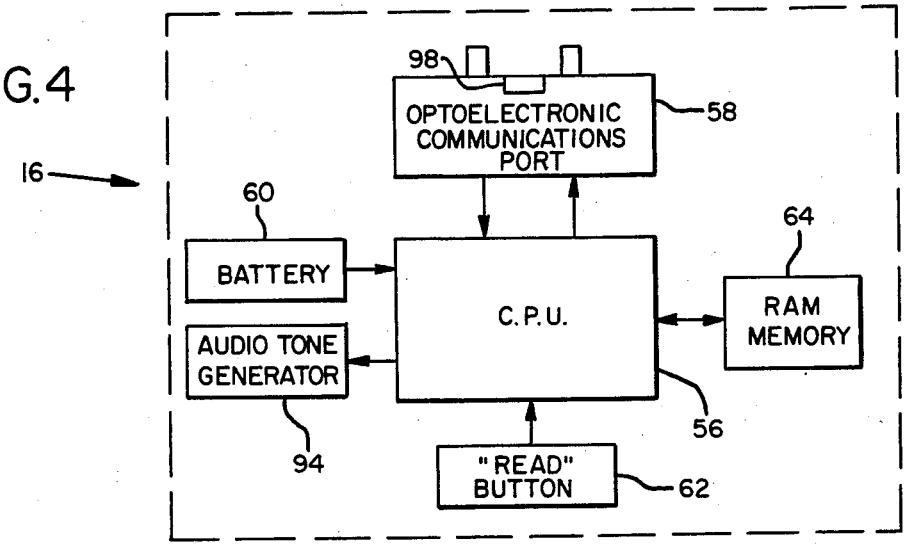
FIG. 4 is a schematic block diagram of a reader key used in the system of FIG. 1.

The Level One, or basic, system 10, shown in FIG. 1, includes one or more lockboxes 12, agent keys 14, reader keys 16, programmer keys 18 and data communicator units 20. (A "pod" 102 used in the Level Two system is shown in dashed lines.) Lockbox 12 contains the door key to the listed dwelling and is mounted securely on or near the dwelling. Agent key 14 is used by real estate agents to open the lockbox and gain access to the key contained therein. Reader key 16 and programmer key 18 are used to read data from, and load instructions into lockbox 12, respectively. Data communicator unit 20 is used to recover the data read by reader key 16 and to load instructions into programmer key 18. These elements are described in more detail below.

Lockbox 12 includes a secure enclosure 13 designed to hold house keys, business cards, written messages and the like. The lockbox is securely attached to the listed house or other fixed object by a shackle 22 or by screws (not shown). Shackle 22 in most instances attaches the lockbox to a door knob, water spigot or porch guardrail. Upon a proper exchange of signals between lockbox 12 and an agent key 14, as described below, the lockbox compartment opens, allowing access to the house key and other materials stored inside.

In the preferred embodiment, the exchange of signals comprises a three-way handshake. First, the agent key 14 sends a first control signal (a) to lockbox 12 which includes a key identifier code identifying the agent, the agency, the real estate board and the agent key serial number. If the lockbox recognizes the first control signal as being property authorized, it then responds by sending a second control signal (b) back to the agent key identifying the lockbox. Upon receiving the second signal from the lockbox, the agent key determines whether the lockbox is one to which it is authorized access. If such a determination is favorable, the key sends a third, unlocking signal (c) back to the lockbox. The lockbox storage compartment 13 then opens.

All communications with lockbox 12 are effected optoelectronically. Lockbox 12 is equipped with an optoelectronic communications port 24 which includes a transmitting light emitting diode (LED) 26 and a receiving photodetector 28. All keys and other units which communicate with lockbox 12 have a corresponding optoelectronic communications port comprising a reciprocal photodetctor and LED pair.

The agent key 14 has length and width dimensions comparable to a credit card, and a thickness of approximately a quarter inch. The circuitry of agent key 14 is shown in FIG. 2 in block diagram form. A 16-key keypad or other switch mechanism 30 is connected to a central processing unit (CPU) 32, which is powered by a battery 34. The user energizes the key by pushing an "ON" button on keypad 30. A "STATUS" L.E.D. 36 then begins to flash, indicating that agent-key 14 is energized. (Alternatively, an audible tone generator, not shown, can be substituted for the L.E.D. 36.) The user then has ten seconds within which to enter a four digit password on keypad 30. If no password code is entered, a timer 44 in agent key 14 causes the key to become deenergized again. If the four digit sequence matches the sequence stored in an agent key RAM memory 30, the key becomes "armed." After the key is "armed," the user can press an "OPEN" button on keypad 30 which causes CPU 32 to send the above-described first control signal (a) to lockbox 12 using a transmitting L.E.D. on its optoelectronic communications port 42. Agent key optoelectronic communications port 42 also includes a receiving photodetector 46).

If an improper four digit password is entered on touch pad 30, agent key 14 will not arm and will not send a signal to lockbox 12. The user can then start over and enter the proper password. If, after five tries, the proper password is still not entered by the user, the CPU 32 is configured so that agent key 14 will deactivate itself for a ten minute period and will not allow any further codes to be entered.

Agent key 14 is initially activated by a programming routine that is run on data communicator 20. This routine loads a variety of information, and enables a number of functions, into the agent key. The information loaded includes the agent, agency, board, password, and key expiration date (discussed below). Functions enabled may include shackle release (discussed below). After its initial activation, the agent key will not require further programming, except for periodic rejuvenation (also discussed below).

FIG. 3 is a block diagram showing circuitry of lockbox 12. Photodetector 28 of lockbox optoelectronic communications port 24 receives the first control signal (a) from the transmitting LED 40 of the agent key 14. It then decodes this signal and feeds it to a lockbox CPU 48. (CPU 48 and other lockbox circuitry is powered by an internal battery 50.) If the CPU recognizes the first control signal as corresponding to an authorized key, lockbox 12 returns the second control signal (b) to agent key 14 using transmitting LED 26 of optoelectronic communications port 24. If CPU 48 does not recognize the key identifier code sent from agent key 14 in first signal (a), or determines that the key identifier code is otherwise invalid, lockbox 12 will not respond with the second signal (b).

The second signal (b) sent by lockbox 12 to agent key 14 includes an assignment code identifying the board, agency and agent which listed the house. When agent key 14 receives this assignment code, its internal CPU 32 scans a list of authorized codes stored in its internal RAM memory 38 and compares the authorized boards in this list with the received assignment code. If the board recited in the lockbox assignment code is one of those stored in agent key memory 38, the key transmits the third signal (c) to lockbox 12. This third signal (c) is received and decoded by optoelectronic communications port 24 and CPU 30 of lockbox 12. An output from CPU 48 to a lockbox compartment lock 55 then causes the compartment to open.

Lockbox CPU 48 maintains a lockbox access log in a lockbox RAM memory 54 which logs all accesses. Each entry in the log includes the key's identifier code, the time and date of the attempted access (obtained from an internal calendar-clock circuit 52), and the access result. The access result entry can, for example, indicate: access allowed, key on lockout list, daily timed disable lockout, or unarmed key (lockout list and daily timed disable are discussed below). The lockbox RAM memory can log such information on 100 lockbox accesses.

This log can later be retrieved by the reader key 16. Such operation transfers a copy of the access log to the reader key for later display by the data communicator unit 20.

The reader key 16, shown in FIG. 4, is similar in many respects to agent key 14. It includes a CPU 56, an optoelectric communications port 58, a battery 60, a "READ" button 62 and a large RAM memory 64. The access log stored in lockbox RAM 64 can be transferred to the reader key RAM 64 simply by pressing the "READ" button and optically coupling the reader key and the lockbox. If optical coupling is not achieved within a preset time period, the key returns to its inactive state. The reader key RAM 64 is large enough to store the access logs of ten different lockboxes.

Like the agent key 14, the reader key 16 is initially activated by a programming routine that is run on data communicator unit 20. This routine loads a variety of information into the reader key, such as the identity of the operating agency and the length of the preset delay period. Thereafter, no further programming is required. (Memory pointers to reader key RAM 64 are reset each time the contents of the RAM are transferred to the data communicator unit.)

The data communicator unit 20 includes a single board computer (SBC) 66 having an optoelectronics port 68 identical to that included in lockbox 12. This port is constructed as part of a nest 70 designed to receive any of the three keys (agent key 14, reader key 16 and programmer key 18). When a key is inserted in the nest, it becomes optoelectronically coupled to the single board computer 66 inside the data communicator unit. The single board computer can retrieve access log data from the keys or load new operating parameters into them (discussed below). In this manner, keys can be loaded with, and dumped of data as appropriate.

Data communicator unit 20 is typically installed, in the Level One system, at the real estate board office and is connected to a CRT monitor 72, a printer 74 and a keyboard 76. When a reader key 16 is inserted into the data communicator unit nest 70, the access log data stored in the key can be retrieved and displayed on monitor 72 or printed by printer 74. In this manner, a record showing which agents visited the homes and at what times can be provided.

Figure 5:
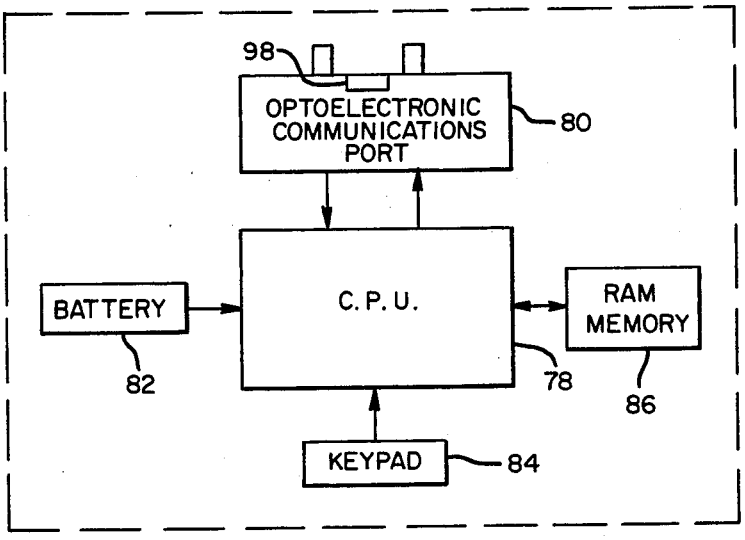
FIG. 5 is a schematic block diagram of a programmer key used in the system of FIG. 1.
Figure 6:
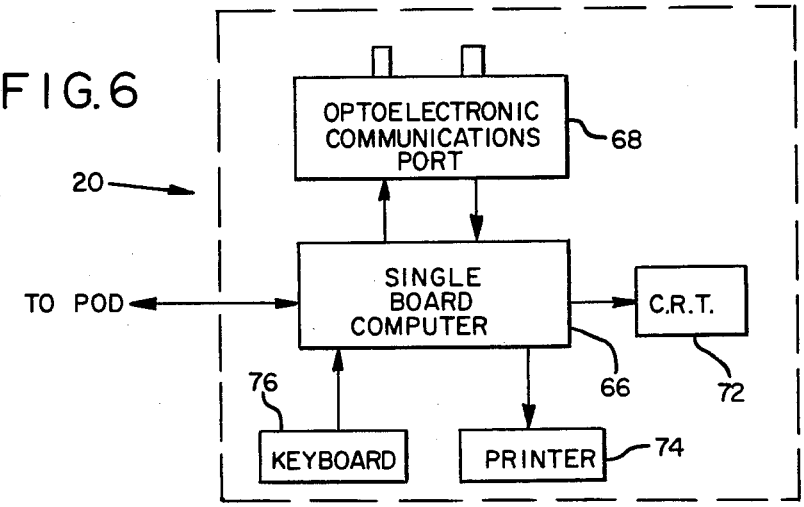
FIG. 6 is a schematic block diagram of a data communicator unit used in the system of FIG. 1.
Figure 7:
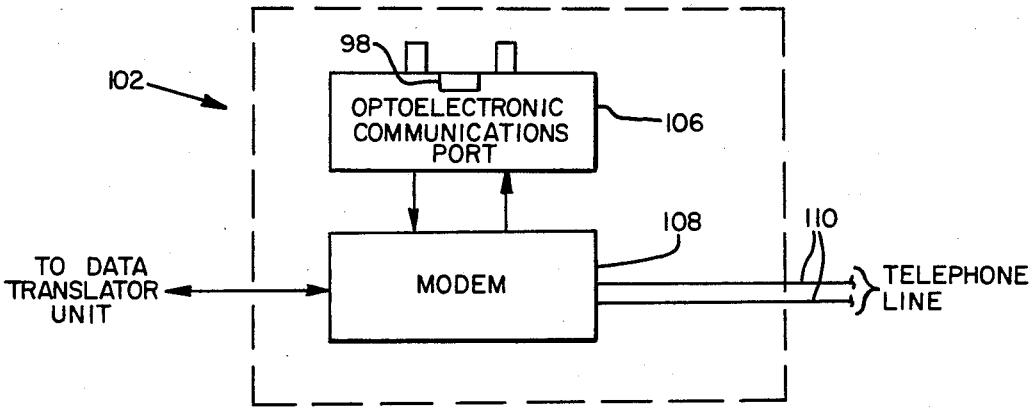
FIG. 7 is a schematic block diagram of a pod used in an enhanced version of the system of FIG. 1.

Data communicator unit 20 can also be used, in conjunction with the programmer key 18, to reprogram lockboxes 12. Programmer key 18, shown in FIG. 5, is again similar to agent key 14. It includes a CPU 78, an optoelectronic communications port 80, a battery 82, a small keypad 84 and a RAM memory 86. The programmer key RAM memory 86 is loaded by the data communicator unit 20 with information destined for the lockbox 12. The information loaded into programmer key 18 includes the listing agent and the listing agency, and serves to enable various lockbox features, such as daily timed disable and lockout list (these features are discussed below). When programmer key 18 and lockbox 12 are subsequently optically coupled, this information can be transferred from the programmer key RAM 86 to the lockbox RAM 54 by pressing a "PROGRAM" button on programmer key keypad 84.

In more detail, reprogramming of the lockbox is effected as follows. The programmer key 18 is first inserted into the data communicator unit nest 70. A lockbox programming routine, stored in a data communicator memory 88, is then run on the data communicator single board computer 66. This routine allows various parameters and features of the lockbox (as discussed above) to be changed. The reprogramming routine presents menus on the CRT monitor 72 to facilitate such programming. When suitable lockbox program parameters have been established, the data communicator unit single board computer 66 loads them into the memory 86 of the programmer key 18. The programmer key can then be taken from the data communicator unit nest 70 to the lockbox and can transfer the new operating parameters to it through the two units' optoelectronic communications ports. All "programming" of lockbox 12 referenced below is effected, in the Level One system, by this technique.

The following discussion details some of the functions of the preferred embodiment of the Level One system:

Daily Lockbox Disable

Oftentimes, homes listed by real estate agents are not vacant. The current owners are still residing in the house and may not welcome visitors at certain hours. For example, a homeowner may wish that his house not be shown between the hours of 7 p.m. and 10 a.m. Accordingly, CPU 48 of lockbox 12 can run a software routine, stored in lockbox memory 54, that disables the lockbox from opening during certain predetermined hours of the day. The daily lockbox disable software routine operates in conjunction with the real time clock 52 internal to the lockbox. This function is enabled by selecting the Daily Timed Disable option which appears on the CRT 72 during programming of the programmer key 18 by data communicator unit 20. If this option is selected, the data communicator unit 20 then asks the times during which the lockbox is to be disabled. This data is loaded into the programmer key 18, which in turn loads it into the lockbox memory 54, as discussed above.

Key Expiration

To enhance security of the system, some or all of the agent keys 14 can be programmed to expire (become disabled) after a certain number of days or weeks. By this technique, keys that are lost or stolen lose their utility in a relatively short time. The key expiration feature can be implemented using a real time clock 90 internal to agent key 14, or can be based simply on a long term timer (not shown). If this feature is adopted, the supervising authority (typically the real estate board) can then specify how long the key is to remain active before automatically disabling itself.

After a key has expired, it must be rejuvenated (in the Level One system) by a data communicator unit 20 before it can be used again.

Lockbox Disable

At times, it may be advantageous to render the contents of the lockbox 12 inaccessible to everyone at all times. This is another lockbox operation option that can be selected when lockbox functions are loaded into the programmer key 18 by a data communicator unit 20.

Key Disable

The agent key 14 can be deactivated, upon command, to disable its further use. For example, when an agent leaves his employment, he may wish to disable his key so that no one can take it from storage and use it. After being deactivated by the agent, the key must be reinitialized by a data communicator 20 before it can be used again.

Electronic Shackle Release

The shackle 22 or mounting bracket which secures the lockbox to the structure is, in the preferred embodiment, electronically releaseable. Certain agent keys 14 can exercise this capability by pressing a "SHACKLE" button on the agent key keypad 30. However, not all agent keys are able to release all lockbox shackles. In order for an agent key to release a shackle, the key must have certain authorization bits set in its RAM memory 38. Depending on which bits are set, the key will be able to release shackles of lockboxes assigned to that agent, to that agent's agency, or to that agent's board. (The agent key determines the lockbox assignment from the contents of the second signal (b), which identifies the parties that are authorized to unlock the lockbox.) By allowing real estate agents, rather than just real estate board employees to remove lockboxes, administration of the system is greatly facilitated.

Lockbox Disable Upon Removal

After a real estate agent has released a lockbox shackle, the lockbox could normally be reinstalled on another house. Before such installation, however, the lockbox must be reprogrammed with a variety of information, such as the listing agent, the listing agency, the listing number, the daily timed disable periods, etcetera. This reprogramming is normally accomplished by loading a programmer key 18 with the new data and loading the lockbox from the programmer key, as discussed above.

In large systems (discussed below), the above "on the fly" reprogramming procedure is undesirable. It does not guarantee that the data loaded into the programmer key 18 is actually transferred into the lockbox. In systems where data integrity is important, it is desirable that the lockbox be programmed directly by the system (by a "pod," as discussed in the Level Two system, below) without the use of an intermediate programmer key. To insure that "on the fly" reprogramming of lockboxes is not done, a Lockbox Disable Upon Removal feature is selectably provided.

When the Lockbox Disable Upon Removal feature is used, the lockbox becomes disabled when the shackle is released. In this disabled state it cannot be reprogrammed by the programmer key; it must be returned to the board (or agency) office for reprogramming. By requiring the lockbox be returned for reprogramming, the board is more reliably informed of the program status of each lockbox, and the integrity of the board's lockbox database is maintained.

Data Communicator Unit Protection

The software resident in the data communicator unit 20 contains sensitive information and coding which, if widely known, could pose a threat to the security of the listed houses. Accordingly, it is important that this software not be available to unauthorized users.

Normally, once a software pirate has gained access to a ROM chip containing CPU software, it is a simple matter to copy the chip and dump its contents in a computer listing. The code can then be disassembled and examined to discover the proprietary information.

To avoid this potential problem, the software in the data communicator unit of the present invention is stored in a volatile RAM memory 88. As long as power is provided constantly to this memory, its contents will remain intact. If, however, power is momentarily lost, all software stored in the RAM will be lost as well. Interrupt switches 92 are provided inside the data communicator enclosure to interrupt power to this RAM if the enclosure is opened. In this manner, security of the software stored in the RAM is provided. (The data communicator is normally powered by conventional alternating current, but has a built-in battery back up to protect against loss of software in the event power fails.)

If someone tampers with the data communicator unit, causing the RAM 88 to lose all software, the data communicator must be reprogrammed by the vendor. This can be done either by sending the unit back to the vendor or by reprogramming over telephone lines, as discussed more fully below. In either event, the vendor would reprogram the unit only after the issue of the data communicator's physical security had been investigated and resolved.

Communicator Security While In Shipment

As noted, the data communicator unit 20 contains sensitive information that might be used to breach system security if used by unauthorized persons. The RAM based software, described above, is one technique for preventing improper use of the data communicator software. Another concern, however, is that a data communicator unit might be intercepted from the mail while being shipped from the vendor to the end user. Even without opening the enclosure to pirate the RAM software, the mere possession of the unit by unauthorized persons poses some security risk.

To overcome this problem, the data communicator units are shipped in a disabled mode. For example, they can be shipped with software that will not operate until it receives certain enabling code sequences. The vendor could call the recipient and give these codes orally after the data communicator's safe arrival had been confirmed. The user could then enter these enabling codes into the data communicator unit with the keyboard 76. Alternatively, if a phone line is coupled to the data communicator unit (as described below), the enabling codes, or the entire data communicator software can be transmitted from the vendor directly to the data communicator unit. In either case, the data communicator would be useless to those who obtained mere possession of the unit.

Agent/Reader Keys

Normally, the agent who uses an agent key will not need the capability of retrieving data from a lockbox. However, to minimize costs of administering the system, it is sometimes desirable that agents be able to retrieve such data and return it to the agency or board office. In such case, the agent key can be equipped with the functions of a reader key, together with a correspondingly large memory, to facilitate transfer of access logs from lockboxes to the agency or board office.

Acoustically Coupled Key

Normally, the access log data retrieved from lockbox 12 by reader key 16 is transferred to the system (i.e. the data communicator unit 20) optoelectronically. In certain instances, described more fully below, it may be desirable to download data from the reader key over telephone lines. For this function, reader key 16 is equipped with an audible tone generator 94 which can be selectively enabled by the user. When so enabled, it can transmit data in an acoustical, rather than an optical format. The key can be held up to the mouthpiece of a telephone to effect the acoustical coupling to the phone line. By this technique, data can be downloaded from a reader key to a data communicator unit coupled to a phone line (discussed below) without the necessity of physically returning the key to the data communicator unit.

Mark File

As noted, the access log maintained in the memory 54 of the lockbox 12 contains data relating to the last 100 accesses. Transfer of this data to a reader key or to an agent/reader key is accomplished quickly, due to the use of optical communications. If, however, the reader key uses its acoustical coupling capability to transfer this data to the system, the resulting data transfer takes a comparatively long time, during which the reader key and telephone handset must be maintained in acoustical communication. Maintaining acoustical communication between these units is not difficult, but can be made even more simple if the data transmission is shortened. Oftentimes, not all 100 past accesses are of interest. For example, the supervising real estate board or agency may only be interested in accesses over a certain period of time. To facilitate this function, the lockbox memory 54 can be marked with one or more flags. This memory can then be read from the last flag to the end, or just between two flagged positions. By this technique, only the data of interest is transferred.

As noted, the mark file function is useful when a real estate agency or board is interested in monitoring the access to a home during a specific period, as for example during a weekend that the house is advertised in the newspaper. In such case the lockbox can be commanded, with a programmer key, to flag the next memory location as the beginning of the flagged list. This would be done on Friday evening. An agent would then return Monday morning and recover just the entries in the access log made since the flagged time. Alternatively, the agent could insert a second flag in lockbox memory 54 without retrieving the data, thereby allowing the flagged entries from this time period to be recovered later. If a lockbox is moved from one house to another, a flag can mark the move so that the move is indicated on the access log. Data can then be selectively recovered from the lockbox so that only accesses at the new location are recovered.

As another option, the reader key or agent/reader key can be operated to retrieve only the last N entries stored in the lockbox access log (where N is selected by the user). This may be useful, for example, to determine who recently opened the lockbox.

Reed Switch

The photodetector 28 in the optoelectronic port 24 of the lockbox 12 generates a signal whenever it is exposed to light. Such a signal can be used to switch a lockbox from an idle to an active state. Such photodetectors, however, are also sensitive to ambient light, such as sunlight and porch lights. To prevent the undesired activation of the lockbox, and consequent increased drain on its internal battery 50, a reed switch 96 is provided in the power circuitry of the lockbox. This reed switch is normally open, thereby leaving all of the lockbox circuitry, except the internal clock 52 and memory refresh circuitry, in an unpowered state. A magnet 98 is mounted in the optoelectronic communication port of each key and causes the lockbox reed switch 96 to close when the key is brought in close proximity thereto. In this manner, the lockbox is maintained in a substantially idle state until a key is held in proper position. Power is then applied to all lockbox circuits and the lockbox becomes active. This reed switch feature also increases security by rendering the lockbox unresponsive to attempted accesses by makeshift keys.

Preload Permission Code

As noted, the agent key 14 must be held next to the lockbox 12 in order for the units to communicate optoelectronically. Although not usually a problem, this task is sometimes difficult when the lockbox is mounted in an awkward location, such as on a water spigot mounted at ground level. Ordinarily, the agent would have to engage the key with the lockbox in such position and then start pressing buttons on the agent key corresponding to the required password and auxiliary permission codes (discussed below). This task is even more tedious at night.

To obviate this potential problem, the agent key 14 of the present invention can be preloaded with all of the password and permission codes needed to access the lockbox. The key can then be mated momentarily with the lockbox and the handshaking exchanges made automatically upon closure of the lockbox reed switch 96. Thus, the agent need not press a single key in the dark or cramped location in which the key and lockbox are mated in order to open the lockbox. The password and auxiliary permission codes can be preloaded in a well-lit, convenient location, such as in a car. The agent then has two minutes within which to use the preloaded agent key to open the lockbox. After this period the preloaded information is lost, thereby aiding in system security. This feature greatly facilitates opening lockboxes mounted in awkward or poorly lit locations.

Audit Trail

Occasionally, a vendor will receive reports that a lockbox or key is inoperative. To aid in investigations of such reports, the lockbox and keys of the present invention include a section of their RAM memories dedicated to storing detailed information on the last ten attempted operations. This information identifies the type of operation attempted, whether it was successful, and any error messages generated by an unsuccessful operation.

The audit trail of an exemplary agent key operation might be as follows. The key is energized by the "ON" button. The four digit password is then entered, followed by a keystroke (or keystrokes) identifying the desired operation (such as release shackle or open lockbox). If an incorrect password is entered, an unsuccessful attempt to arm the key would be stored in the agent key audit trail, with an error message indicating use of an incorrect password. If an operation is attempted but is unauthorized (i.e. unauthorized shackle release), a corresponding entry would be made in the agent key audit trail.

The audit trail of an exemplary lockbox operation might be as follows. The lockbox is activated by closure of the reed switch, but the key is improperly inserted so that optical communication cannot be established. An unsuccessful attempt to communicate with the lockbox would then be logged in both the lockbox and agent key audit trail.

Upon reports of a malfunctioning lockbox or key, the corresponding audit trail can be retrieved, either by sending the unit to the vendor or by coupling it to the vendor through a modem (described herein) to facilitate resolution of the anamoly.

Lock Out List

In certain instances, it may be desirable to lock out certain agents, or agents from certain agencies, and thereby deny them access to a listed property. In the preferred embodiment, RAM 54 of lockbox 12 contains a list of key identifier codes that, although nominally valid, are to be locked out. The identifier code of the accessing agent key is compared against this list by lockbox CPU 48. If the accessing key's identifier code is found in this list, lockbox 12 will abort the handshaking exchange and deny access to the key compartment.

As a further option, the lockbox CPU 48 can be programmed to disable any locked-out keys that attempt to access the lockbox. In this case, lockbox CPU responds to the first signal sent by the agent key with a special second signal that scrambles the RAM memory 38 of the agent key so that the key is rendered inoperative. In the preferred embodiment, the lockbox scrambles the four digit password that must be entered by the user to "arm" the agent key, by replacing certain digits of the password with hexadecimal digits (A-F) which are not included on the agent key keypad 30. With the password thus scrambled, the user can no longer "arm" the key and initiate a handshaking exchange with any lockbox. The password can only be unscrambled by reprogramming the agent key, which operation is usually only performed by the supervising real estate board.

Exclusive Listings

At times, an agency may wish to list a property exclusively, denying access to agents from other agencies. In this case, the lockbox is programmed to open only for agents from the listing agency, and to deny access to all others.

Multi-Board Capability

It is sometimes desirable to make a listed house available to agents from a plurality of different real estate boards. Normally, keys owned by one real estate board will not be able to open lockboxes owned by another real estate board (the second signal (b) sent from the lockbox to the key will not correspond to a lockbox that the key is authorized to unlock). In the present invention, a section of lockbox memory 54 is used to store identification codes identifying up to fifteen real estate boards which are authorized to access the lockbox. All fifteen of these board identification codes are sent with the second signal (b). If the key is authorized to open lockboxes from any one of these boards, the key will respond with the third, unlocking signal (c). By this technique, properties in large metropolitan areas, served by several real estate boards, can be accessed by agents from all cooperating boards.

Auxiliary Permission Code

In normal operation, the lockbox 12 must receive a proper key identifier code from the agent key 14 (signal "a") during the handshaking exchange before the lockbox will open. Optionally, the lockbox can be programmed to require that an additional four digit permission code be received before the lockbox opens. This auxiliary permission code is entered onto the keypad 30 of the agent key by the agent when opening the lockbox. This code is then passed to the lockbox as part of the key identifier signal (signal "a"). If this auxiliary permission code matches a corresponding auxiliary permission code stored in the lockbox, the lockbox will continue with the handshaking exchange. Otherwise it will abort the attempted entry. This auxiliary permission code thus limits access to the house to those agents who know the four digit auxiliary permission code.

Typically, this feature is used to allow a real estate agent to personally limit the agents who have access to the listed house. This is another option that can be selected (typically by the board) when the lockbox is programmed. Thereafter, any agent who wishes to show the house must first call the listing agent to obtain the auxiliary permission code.

In the preferred embodiment, the lockbox CPU 48 automatically changes this auxiliary permission code every day, week or other period, as directed during programming of the lockbox, by using an encrypted algorithm. This algorithm is reseeded each time it is executed. A similarly programmed computer 100 at the agency or board office can compute the current auxiliary permission code by this same algorithm. Only the listing agent, however, is allowed to retrieve this number from the board computer. In this manner, the listing agent can carefully monitor and screen the agents who are allowed to show the listed house.

A lockbox that is programmed to require entry of this auxiliary permission code is also programmed to recognize the listing agent's normal key identifier signal (signal "a"). If it recognizes the agent seeking access as being the listing agent, the lockbox will not require entry of the auxiliary permission code.

LEVEL TWO SYSTEM

The Level Two system represents a small increase in cost and complexity over the Level One system, but enables a large number of additional features. The Level Two system includes all of the components used in the Level One system and further adds a "pod" 102. Pod 102 is an accessory to the data communicator unit 20 and is designed to be electronically and physically coupled thereto. The pod includes a nest 104 and an optoelectronic communications port 106, similar to those included in the data communicator unit 20, but designed to receive lockboxes instead of keys. As a further feature, the pod includes a built-in modem 108 to enable both the pod and the coupled data communicator unit to send and receive data over a telephone line 110.

The pod's most immediate function is to program lockboxes 12 directly. No longer must an agency use the intermediate step of programming a programmer key 18 to program a lockbox. Instead, the lockbox can be inserted into the pod nest 104 and programmed directly by the coupled data communicator 20.

The built-in modem 108 also greatly increases the utility of the present invention. For example, it allows software to be loaded and certain command sequences to be sent directly from the vendor to the data communicator/pod assembly. By this technique, software in these units can be updated periodically as new features are added to the system.

LEVEL THREE SYSTEM

The Level Three system includes the components found in the Level Two system, but substitutes a personal computer, such as an IBM PC (not shown), for the monitor 72 and keyboard 76. The addition of a PC substantially increases the system's capabilities. For example, access log data can be archived from the reader keys 16 onto a disk storage, instead of merely printed on a paper printout. The data can then be organized and manipulated by any popular PC database program.

In addition to the improved hardware capabilities, the Level Three system also offers an opportunity to use enhanced software routines. The single board computer 66 in data communicator 20 typically comprises a simple microprocessor with a limited instruction set. By adding a PC to the system, an enhanced version of the system software can be used, thereby leaving the data communicator single board computer to act as a smart input/output port. A software switch can be employed to determine whether the communicator processor or the PC is to operate the system. As a further benefit, special function keys on the personal computer can be preprogrammed to facilitate certain operations, so that long command sequences need not be entered.

LEVEL FOUR SYSTEM

The Level Four system is a comprehensive, integrated system designed to fulfill all lockbox management needs of a large real estate board.

Figure 8:
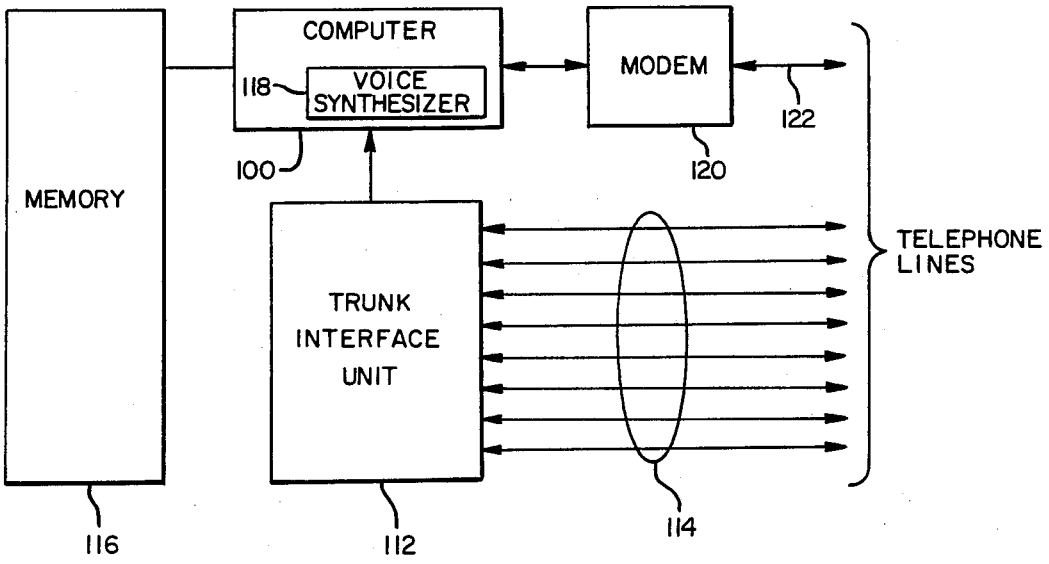
FIG. 8 is a diagram of a computer and trunk interface unit used in another enhanced version of the system of FIG. 1.

Some large real estate boards have tens of thousands of lockboxes and keys in their systems, so an integrated management system is virtually essential. The Level Four system uses a computer 100 (shown in FIG. 8), resident at the board office, which interfaces with a plurality of Level Two and Level Three systems, resident at selected remote real estate agencies. The computer. is desirably a multiuser, multitasking system with large amounts of online storage. A super microcomputer such as the NCR Tower system is a suitable machine.

Connected to super microcomputer 100 is a trunk interface unit 112, which allows a plurality of telephone lines 114 to interface with the super microcomputer simultaneously. In the preferred embodiment, eight telephone lines are used. The trunk interface unit allows the computer 100 to be interrogated over telephone lines and allows data to be exchanged with remote data communicator/pod assemblies. In such capacity, the data communicator/pod assemblies can function as remote input/output ports for the board computer and the data communicator's single board computer 66 can function as a smart input/output controller.

The trunk interface unit 112 also allows reader keys to download lockbox access logs directly into the board computer 100 over a telephone (without transporting the key to a pod-equipped agency) by using the audio tone generator 94, as noted above.

In the typical Level Four system, the communicator/pod assemblies installed at remote agencies are limited to performing certain preselected functions. For example, an agency communicator/pod assembly is typically enabled to update certain lockbox parameters meters (i.e. change agents listed on the lock-out list time periods for the daily disable, etc.), but cannot initialize the lockbox (i.e. select the real estate boards to which the lockbox will be accessible or disable the Lockbox Disable Upon Removal feature). Similarly, the agency communicator/pod assembly is typically enabled to deactivate agent keys, but cannot rejuvenate them. Such restricted functions can only be performed by the board computer 100.

Super microcomputer 100 is used to keep track of all data pertinent to the system. Whenever a key or lockbox is read or programmed, the corresponding data is entered into a system database. This database, located in computer memory 116, includes information on all of the features and parameters heretofore mentioned, for each lock and key in the system. Computer 100 can search the database for any category of information and can generate corresponding written reports on any such subject. By such reports, the board can better target its activities. For example, the board can search the database to determine which listed properties have not been shown often and then suggest to the member agencies that the advertising of these properties be increased. Similarly, the board can monitor man-power trends and suggest staffing schedules that allocate agency personnel to the offices and at the times that the demand is greatest. The use of multitasking in super microcomputer 100 allows such searches and reports to be performed in the "background" while highly interactive tasks, such as word processing, are done in "foreground".

The Level Four system offers many advantages to real estate boards that span large territories. For example, the agent keys 14 are usually programmed to expire periodically and must be rejuvenated. This is desirably done by the real estate board so as to maintain control over key usage. Accordingly, most data communicator units (resident at agencies) are not enabled to rejuvenate expired keys. The agents could travel to the board offices periodically to have their keys rejuvenated, but in large metropolitan areas this may be burdensome. The Level Four system allows agents to complete all such transactions with the board over telephone lines. To rejuvenate an expired key, the agent would insert the key in the nest 70 of the data communicator unit 20 and invoke the appropriate routine in the single board computer 66. This routine would instruct the data communicator/pod assembly modem 108 to call the board computer, exchange the appropriate handshaking signals and receive from the board computer the signals needed to rejuvenate the key resting in the nest.

As noted in the auxiliary permission code discussion above, the board computer 100 contains all auxiliary permission codes used in the system and updates them, by the encrypted algorithm, on the preset periodic basis. The listing agent who needs to know an updated auxiliary permission code can dial the board computer and identify himself or herself by a unique password code. This password code can be entered by Touch Tones on a conventional Touch Tone phone. The board computer, through a voice synthesizer 118, can then recite the new auxiliary password for that agent's listing. Any other agent who wishes to see the house must first obtain this auxiliary code from the listing agent.

The board computer 100 desirably has a modem 120 and an outgoing phone line 122 with which it can communicate with the vendor. Updated software can be reloaded using this link. Other diagnostic routines, such as deciphering an audit trail contained in a lockbox or key, can be effected by the vendor using this link to the local board office.

The board computer includes several security measures. For example, all requests for service to the computer must include proper password codes before any transactions can take place. Certain particularly sensitive transactions may require that a user call the computer, send the appropriate password codes, and then hang up, allowing the computer to call the user back on a predetermined telephone line. With these and other techniques, security of the system is maintained against intruders, even if the security of the password codes is breached.

As can be seen from the above discussion, the addition of computer 100 and its associated equipment in the Level Four system greatly increases the system's utility, and provides large real estate boards with a versatile, comprehensive and integrated lockbox management system.

Having illustrated and described the principles of our invention with reference to one preferred embodiment and several variations thereof, it should be apparent to those persons skilled in the art that such invention may be modified in arrangement and detail without departing from such principles. For example, although the system is described with reference to a lockbox system for containing dwelling keys, it is readily adaptable to other uses. Similarly, although optical coupling between units is employed in the preferred embodiment, a variety of other coupling techniques could alternatively be used. Accordingly, we claim as our invention all such modifications as come within the true spirit and scope of the following claims.

We claim:

1. A lockbox comprising:

a controlled-access compartment;

receiving means for receiving data from a key;

processing means for processing data received from the key and for allowing access to the lockbox compartment upon receipt of certain data from the key;

fastening means for releasably fastening the lockbox to a fixed object, the fastening means being operable to release the lockbox from the fixed object upon receipt of a release command; and disable means for denying access to the lockbox compartment after receipt of the release command until after receipt of a lockbox reenable command.

2. The lockbox of claim 1 in which:

the receiving means receives data signals transmitted from an electronic key carried by an agent;

the fastening means is operable to release the lockbox from the fixed object upon receipt of an electronic release command; and the disable means denies agents access to the compartment means after receipt of the electronic release command until after receipt of an electronic lockbox reenable command;

and in which the lockbox further comprises electronic memory means for recording information relating to accesses of the lockbox compartment.

* * * * *